United States Patent [19]

Heller et al.

[11] 4,230,488

[45] Oct. 28, 1980

[54] ABRASION RESISTANT RAILS AND/OR RAIL WHEELS, AND PROCESS FOR PRODUCING THE SAME

[75] Inventors: Wilhelm Heller, Duisburg; Walter Knoor, Bochum; Reinhard Schweitzer, Düsseldorf, all of Fed. Rep. of Germany

[73] Assignee: Fried. Krupp Hüttenwerke AG, Bochum, Fed. Rep. of Germany

[21] Appl. No.: 920,818

[22] Filed: Jun. 30, 1978

[30] Foreign Application Priority Data

Jul. 2, 1977 [DE] Fed. Rep. of Germany ..... 2730045

[51] Int. Cl.[2] ..... C22G 38/60

[52] U.S. Cl. ..... 75/123 F; 75/128 P; 148/36; 295/30

[58] Field of Search ..... 295/1, 30; 148/36; 75/123 A, 123 AA, 123 R, 126 N, 126 R, 128 P, 128 R, 123 F, 123 N

[56] References Cited

U.S. PATENT DOCUMENTS

| | | | |
|---|---|---|---|
| 2,798,805 | 7/1957 | Hodge et al. | 75/123 R |
| 3,424,576 | 1/1969 | Fogheman et al. | 75/123 A |
| 3,726,724 | 4/1973 | Davies et al. | 75/123 R |
| 3,948,649 | 4/1976 | Takahaski et al. | 75/128 P |
| 4,008,078 | 2/1977 | Flugge et al. | 148/36 |
| 4,082,577 | 4/1978 | Heller | 148/36 |

FOREIGN PATENT DOCUMENTS

| | | | |
|---|---|---|---|
| 910309 | 4/1954 | Fed. Rep. of Germany . | |
| 1020535 | 2/1966 | United Kingdom | 75/123 A |

OTHER PUBLICATIONS

"Stahl und Eisen", 90 (1970) pp. 922–928.
"Stahl und Eisen", 95 (1975) pp. 1057–1062.
"Glasers Annalen", 101 (1977) pp. 103–109.
"Archiv für das Eisenhuttenwesen" (1943) pp. 65–76.

*Primary Examiner*—L. Dewayne Rutledge
*Assistant Examiner*—Peter K. Skiff
*Attorney, Agent, or Firm*—J. Harold Nissen

[57] ABSTRACT

Abrasion resistant rails or rail wheels formed from a steel alloy having between 0.02 to 0.35 percent by weight of lead or bismuth, and a process for the production of the same comprising alloying 0.02 to 0.35 percent by weight of lead or bismuth with a rail or rail wheel steel.

12 Claims, 6 Drawing Figures

FIG. 2b.
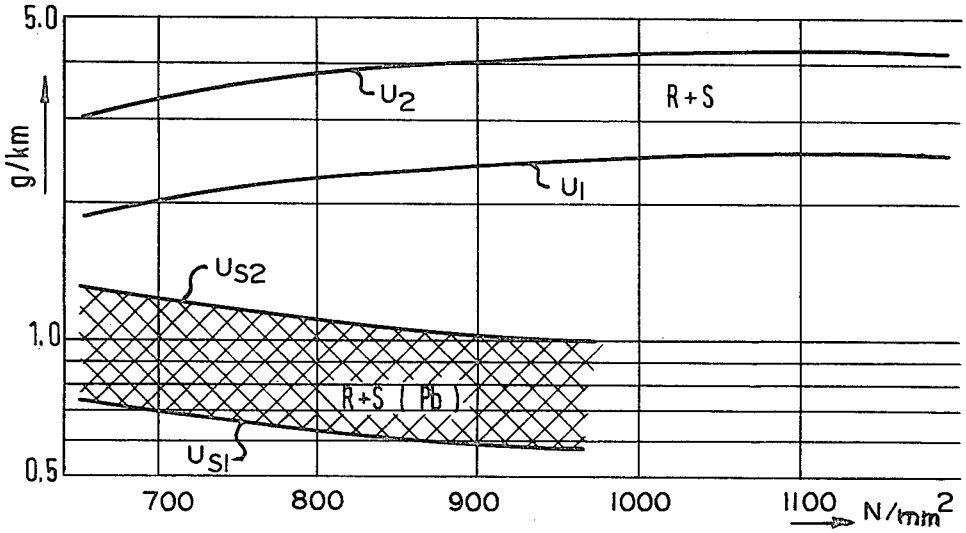
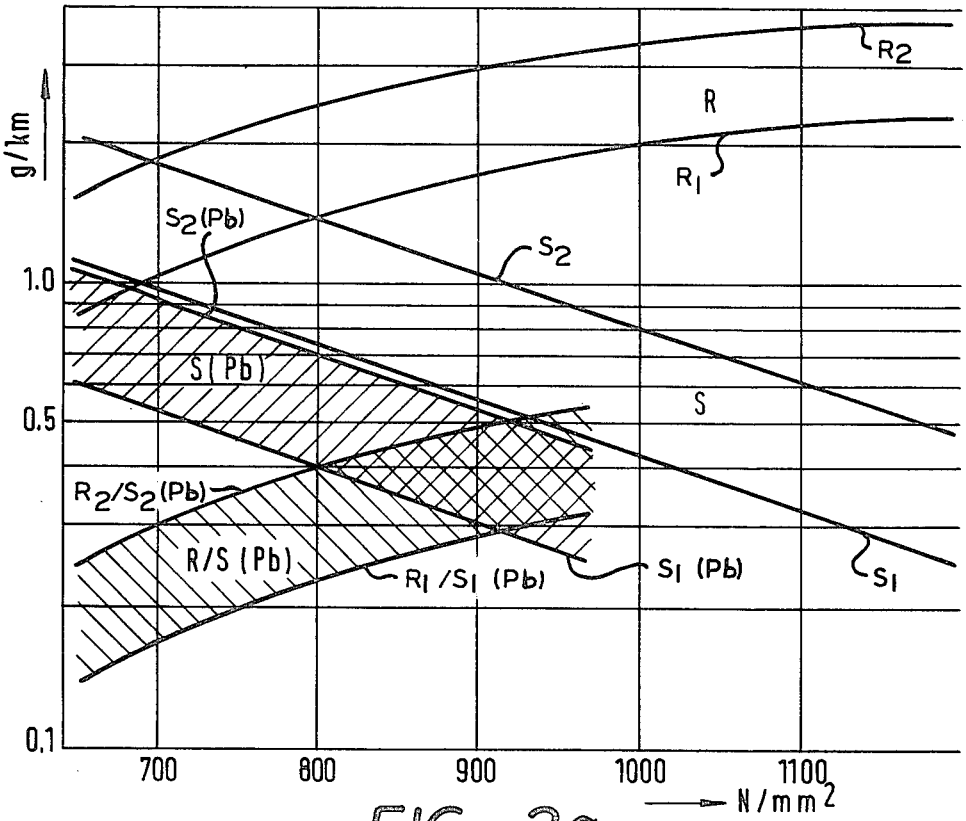
FIG. 2a.

ABRASION RESISTANT RAILS AND/OR RAIL WHEELS, AND PROCESS FOR PRODUCING THE SAME

BACKGROUND OF THE INVENTION

This invention is concerned with increasing the abrasion resistance of steel rails or steel rail wheels, or both.

As is well known, the service life of steel rails and rail wheels is predominantly determined by the wear thereof. Rail wheels are known to be used as a monobloc wheel (a single unitary wheel), or as an outer rim or wheel tire.

The steel rail and rail wheel coact during use such that each abrades the other, and there has been a long-felt need for means to reduce the abrasion of the two abrading partners which takes place between the wheel and the rail.

Many attempts have been made to reduce the abrasion between the rail and the rail wheel, and one such proposal is to increase the strength of the steels used. For this purpose, various alloying elements as well as variations in the heat treatments have been used to increase the strength of these two elements, see "Stahl und Eisen" 90 (1970, pages 922–928) and "Stahl und Eisen" 95 (1975, pages 1057–1062).

It is well known that abrasion is particularly troublesome in connection with curved rails. The publication "Eisenbahntechnische Rundschau" 22 (1973), on pages 214–218 sets forth details with respect to the special connection or relationship between the strength and abrasion behavior which takes place between curved rails and the rail wheel. For example, this publication sets forth that if the strength of the rail steel is increased by 200 N/mm, the abrasion will will drop to about one half of the original amount. With regard to the composition of material for use in rail wheels, reference is especially made to the publication "Glasers Annalen" 98 (1974), pages 93–100; this publication specifies that the abrasion characteristics of the rail wheels are improved with an increase in the strength of the material.

Heat treatment has also been used to decrease the amount of abrasion, and reference is made to "Glasers Annalen" 101 (1977), pages 103–109 which indicates that a change in the structure by heat treatment will have a favorable influence and effect and the reduction of the abrasion resistance between the rail and the rail wheels.

It has also been found that while certain alloying elements are suitable to reduce the abrasion resistance, the quantity of such alloying elements cannot be increased without other deleterious effects resulting. Specifically, it has been found that with the increase of certain of the alloying elements, certain undesired side effects result, and these also have to be taken into consideration. Specifically, there is an increased tendency to fracture due to brittleness and an increased tendency to crack due to hardening, and here reference is made to "Glasers Annalen" 88 (1964), pages 98–108 and 98 (1974), pages 93–100.

It is also known that the abrasion between the rail and the wheel can be reduced by the use of lubricants. These lubricants are applied to the contact surface between the wheel and the rail by means of lubricating devices which are used to lubricant the contact surfaces or by lubricating the wheel rim. Such lubrication can only be achieved in a restricted manner as the adhesion between the wheel and the rail must be maintained.

Moreover, such lubrication must be constantly renewed, and the operating costs of the railway are increased. It is also well known that the heavy abrasion between the rail and the wheels can be reduced by welding an abrasion resistant working material onto the rails and wheels. However, as is also well known, problems can arise due to welding faults which in turn can lead to damages.

It is also known to alloy lead with steel to produce steels having improved machinability; see for example "Archiv für das Eisenhüttenwesen" (1943), pages 65–76, and German Pat. No. 910,309. These publications teach that the addition of lead in the range of 0.03 percent to 0.48 percent provides for a considerable improvement in the cutting properties of cutting equipment. Furthermore, it is believed that the improved machinability is due to the finely distributed lead dispersions which facilitate the division and breaking up of the chips, and further that there is a reduction in the frictional resistance due to the lubricating effect between the working material to be machined and the cutting tool. Furthermore, since there is a reduction in the friction between the material during machining, the temperature is also reduced.

While this information has been available to experts and specialists skilled in the railroad art and in particular those working in the area of abrasion reduction for rails and rail wheels, the knowledge of adding lead to increase the machinability of steel has had no influence or bearing. There has apparently been no recognition or appreciation that the service life can be increased by adding lead to rail steels and wheel working materials, and that this increase in service life can go well beyond 50 percent and even beyond 100 percent for well known rail steels.

Conventional known natural hard steels for use in rails and rail wheels are known from UIC leaflet 860 V, 6th edition of 1, 1, 70 of from "Technische Lieferbedingungen der Deutschen Bundesbahn" TL 918 254, January 1972 edition. A survey in Table I of known natural hard steels is provided.

These natural hard steels can also be present in a heat treated state, e.g. after accelerated cooling from the rolling heat. Reference is also made to German Auslegeschrift No. 2,439,338 corresponding to U.S. Pat. No. 4,082,577 which disclose a special process for producing a very fine pearlitic structure which can be used in a rail steel.

Low-carbonized steels with a low minimum tensile strength is usually not suitable for rails or rail wheels.

It is therefore an object of the present invention to improve the abrasion resistance which takes place between the railroad rail and the rail wheel by simple measures.

SUMMARY OF THE INVENTION

In order to accomplish the aforesaid object, the present invention proposes the addition of lead or bismuth to the steels used for rails, the rail wheels or the so-called wheel tires for rail wheels; lead or bismuth or both in the range of 0.02% to 0.35% by weight is to be alloyed with either the rail tracks or the rail wheels.

In a preferred form of the invention, at least 0.07% of lead and/or bismuth is to be alloyed with the rail steels or wheel steels, and the upper limit is 0.20%.

If lead and bismuth are added together in combination, then the total percentage range is the same as that for either lead alone or bismuth alone.

A further preferred embodiment of the invention is the addition of lead alone.

As indicated heretofore, it has been well known in the prior art to alloy lead with steel to produce machining steels with improved machinability, and here reference is made to "Archiv fur das Eisenhuttenwesen" (1943), page 65–76, or German Pat. No. 910 309. This disclosure teaches the addition of lead in the range of 0.03% to 0.48% to produce a considerable improvement in the cutting properties of the cutting equipment. It is understood that the improved machinability results from the finely distributed lead dispersions which on the one hand facilitate division and breaking up of the chips and on the other hand reduce the frictional resistance because of the lubricating effect between the working material to be machined and the cutting tool. Also, the increase in temperature during machining is reduced because of the reduction in friction.

Also as noted heretofore, while the knowledge of the positive effect of adding lead to the improve the machinability of steel has been available for some time, there has been no application or use of these teachings by rail specialists in order to improve the abrasion resistance of the materials used for rails and rail wheels. The specialists who work with rails and wheel working materials have attempted to improve abrasion resistance by means of increasing the strength of the materials. There has been no teaching or recognition that the service life of rail steels and wheel working materials can be increased by adding lead to the rail steels and wheel working materials; and furthermore, there has been no recognition that with the addition of lead, the service life can be increased beyond 50%, and even beyond 100% for those steels which are known per se as suitable for rails and wheel working materials.

An advantage of the present invention is that the adhesion between the rail wheel and the rail is not impaired by the addition of lead. Therefore, it is possible to make full and complete use of the abrasion reducing effect of the alloying of lead without the reduction in the adhesion values.

Another advantage of the invention is that the so-called screeching noise which occurs on sharp curves is reduced when lead is added to the rail and/or rail wheel.

It is justified to assume that an improved corrosion resistance is produced in addition to improved wear resistance as there are less contact points for corrosion when the surface is less rough. Such assumption is justified by previous attempts and experience. Furthermore, it is particularly important to reduce corrosion and advantageous in industrial areas where particularly heavy corrosion attacks must be reckoned with.

The invention provides for the addition of lead or bismuth in the amounts set forth to either the steel for the railway rail or the steel for the railway wheel in order to reduce the abrasion resistance between the unit formed by the railway rail and the railway wheel. In the process according to the invention, only one of the two partners, the rail or the wheel working material, must be alloyed with the lead or bismuth to achieve an evident extension of service life. By adding the bismuth or lead in the amounts set forth, a steel alloy is provided which can be used for a steel rail or rail wheels to reduce the abrasion resistance between the two when in rolling contact with each other.

Other objects, advantages of the nature of the invention will become readily apparent from the detailed description which follows taken in connection with the following drawings.

BRIEF DESCRIPTION OF THE DRAWINGS

FIG. 1*a* illustrates a prior art rail steel used for rail wheels and railway rails with the abscissa indicating tensile strength and the ordinate indicating abrasion.

FIG. 2*a* is a graphical representation which shows the prior art rails and rail wheels shown in FIG. 1*a*, and in addition illustrates the abrasion resistance between a wheel without lead and a rail to which lead has been added and a graphical representation of a rail alone to which lead has been added.

FIG. 2*b* shows the prior art steels of FIG. 1*b* and the total abrasion of a wheel without lead and a rail with lead added.

DESCRIPTION OF THE PREFERRED EMBODIMENTS

Figure 1B:
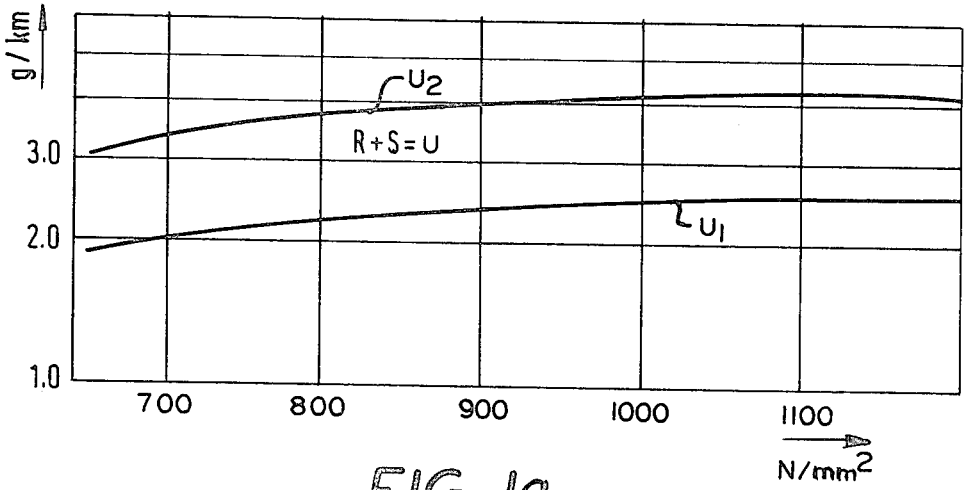
FIG. 1b. PRIOR ART
FIG. 1*b* uses the same ordinate and abscissa as FIG. 1*a*, and indicates the total abrasion resistance for two prior art steels.

There are various steel compositions which can be used for railway rails and railway wheels and which are now used for this purpose. There are also steels which are not quite suitable for railway rails and railway wheels, and the addition of lead and/or bismuth between 0.02 to 0.35 percent by weight will reduce the abrasion resistance between the railway rail and the railway wheel during rolling contact there between.

The following table I provides a survey of the chemical composition of the known natural hard steels (content in percent weight).

TABLE I

| | Carbon | Silicon Maximum | Manganese |
|---|---|---|---|
| Controlled quality according to UIC 860 V | 0.40–0.60 | 0.35 | 0.80–1.20 |
| Abrasion resistant qualities according to UIC 860 V and Deutsche Bundesbahn TL 918 254 | | | |
| A | 0.60–0.80 | 0.50 | 0.80–1.30 |
| B | 0.50–0.70 | 0.50 | 1.30–1.70 |
| C | 0.45–0.65 | 0.40 | 1.70–2.10 |
| Special qualities | 0.40–0.80 with further additions of up to 2 percent Cr; up to 0.25 pecent each of Mo, V, Ti and up to 0.5 percent Nb. | 1.50 | 0.70–2.00 |

Correspondingly good results are also shown in the other natural hard standard steels, e.g. according to the American ASTM Standard A 1-68 or the Russian GOST 6944-63 and GOST 8160-63.

The aforementioned steels can also be present in heat treated state, e.g. after accelerated cooling from the rolling heat. Thus it is known that a very fine pearlitic structure in rail steel is accompanied by an improvement in the properties, in particular in abrasion resistance. A special process for producing such a very fine perlitic structure is described in the German Auslegeschrift No. 2,439,338. The combination of such a very fine pearlitic rail steel with the lead addition enclosed herein is particularly advantageous in retarding abrasion resistance and increasing service life.

A very fine pearlitic structure is essentially one which is so fine that it cannot be resolved by a light-microscope but is not yet a bainitic structure. The lamellar spacing of the pearlite structure is less than $160\times10^{-6}$ mm. An older expression for such a structure is troostite.

Rails or rail wheels thus produced have preferably a minimum tensile strength of 700 N/mm$^2$ and distinguish themselves by a high fatigue strength. They are particularly suited for high axle weight of more than 22t.

The use of lead or bismuth with natural hard, low alloyed steels with minimum tensile strengths of less than 650 N/mm$^2$ and more than 350 N/mm$^2$ is to be particularly emphasised within the frame of the invention. Rails with these strengths can be used, particularly considering that the addition of lead in those cases where lower axle weights of less than 10t arise. This applies for short-distance traffic, e.g. for trams.

The process according to the invention in this combination offers the possibility of using steels with carbon contents of less than 0.4 percent (e.g. St 52-3 or C-35) as rail steels, which steels having as yet not been used as rail steels because they lack sufficient abrasion resistance.

The addition of lead or bismuth increases irregularly the abrasion resistance so that these low-carbonized steels are available for use in rails, whereby the advantage of higher tenacity of these steels can at the same time be used. The following table II shows an example of the ranges of low-carbonized steels with the low minimum tensile strengths.

TABLE II

| | C | Si | Mn | Tensile strength N/mm$^2$ |
|---|---|---|---|---|
| C 35 | 0.32–0.39 | 0.15–0.35 | 0.50–0.80 | 500 |
| St 52 | 0.14–0.20 | 0.20–0.60 | 1.20–1.50 | 500 |

Another advantageous use is offered with high-tensile rail steels which have a bainitic structure and minimum strength of 1100 N/mm$^2$ in the natural hard state or rolling state. Such high-tensile rails are known to the specialist from German Pat. No. 2,302,865. A typical composition is shown by the following table III.

TABLE III

| Elements | Chemical Composition in Percent Weight |
|---|---|
| C | 0.28–0.35 |
| Si | 0.20–1.50 |
| Mn | 0.50–3.50 |
| Cr | 1.25–4.00 |
| Mn + Cr | 2.75–4.50 |
| Mo | 0–0.40 |
| V | 0–0.40 |
| B | 0–0.010 |

The advantageous effect of the lead in the rail wheel, wheel tires or mono-bloc wheels is also shown in all usual compositions. Corresponding analyses can be noted from the UIC leadlet 812-3 V/74 or the "Stahl-Eisen-Liste". The following compositions as set forth in table IV should serve as an example:

TABLE IV

| | (Chemical Composition in Percent Weight) | | | | |
|---|---|---|---|---|---|
| | C | Si | Mn | Cr | Mo |
| (According to UIC 812-3 V/74 (Wheels in Normalized State) | | | | | |
| R 1 | 0.40 | 0.30 | 0.60 | — | |
| R 2 | 0.55 | 0.30 | 0.65 | — | |
| R 3 | 0.65 | 0.30 | 0.65 | — | |
| Special qualities | 0.40–0.80 | 0–0.40 | 0.50–0.90 | 0.20–0.50 | |
| Working material No. | | | | | |
| 1.7215 | 0.25 | 0.90 | 1.0 | 1.1 | 0.25 |
| 1.7228 | 0.50 | 0.25 | 0.65 | 1.1 | 0.20 |
| 1.9976 | 0.68 | 0.35 | 0.65 | 0.40 | — |
| 1.9978 | 0.70 | 0.35 | 0.75 | 0.50 | — |
| 1.0627 | 0.72 | 0.40 | 0.75 | — | — |

The aforementioned rail wheels are in a natural hard or normalised state.

Alternatively, the use of the process according to the invention has shown particular advantages with rail wheels which in their quenched and tempered state have a structure composed of tempered martensite and have a minimum tensile strength of 600 N/mm$^2$.

This also applies for the steels R6 to R9 listed in the aforementioned UIC leaflet 812-3 V/74 which are used for wheels with surface hardened running surfaces, i.e. with wheel tread quenching and tempering.

It is also possible to use new steels for rail wheels. In particular, steels with carbon contents below 0.25 percent and known as non-alloyed and alloyed construction steels can have their abrasion behavior improved by the presence of lead or bismuth. These steels prior to the present invention could not be used as rail wheels, because these steels lack abrasion resistance.

A small grain size is always conducive to strength and toughness, and both a strained condition of the grain and the finely dispersed carbide offer great interference to slip or movement along the slip planes of the grain. Between martensite and pearlite are a number of intermediate structures which are considered by some investigators as modifications of pearlite and have been given the names troostite, bainite, and sorbite, as a convenient means of distinguishing these structure from coursely laminated pearlite. Troostite and sorbite are terms applied to structures obtained in mild quenching or by reheating martensite and are distinguished from it in etching reactions and appearance.

Reference will now be made to figures of the drawing in order to explain the advantageous effects of adding lead or bismuth in the ranges indicated to the steels for use with railway rails or railway wheels.

In order to demonstrate the advantages of adding lead and bismuth, abrasion behavior of rail steels and rail wheel steels was examined both with and without addition of lead and bismuth. The following working material analyses as noted in Table V were the starting point:

TABLE V

| | Chem. composition in Percent Weight | | | | | State of heat | Tensile strength |
|---|---|---|---|---|---|---|---|
| Designation | C | Si | Mn | Cr | Pb | treatment | N/mm$^2$ |
| Rail steel | 0.42 | 0.20 | 0.70 | 0.01 | — | as rolled | 680 to 1280 |

TABLE V-continued

| Designation | Chem. composition in Percent Weight C | Si | Mn | Cr | Pb | State of heat treatment | Tensile strength N/mm² |
|---|---|---|---|---|---|---|---|
| Wheel steel R2 | 0.55 | 0.30 | 0.65 | — | — | normal-ized | 760 |
| According to the invention | | | | | | | |
| Rail steel | 0.37 to 0.8 | 0.20 to 0.50 | 0.70 to 1.30 | — | 0.12 to 0.18 | as rolled | 640 to 980 |
| Wheel steel R2 | 0.5 | 0.25 | 0.70 | — | 0.15 | normal-ized | 730 |

All the steels show a pearlitic and ferritic structure. In the case of the steels according to the invention, the lead was precipitated from the basic working material. The precipitated particles were stretched in the rolling direction with lengths of up to 400 μm and thickness of up to about 10 μm. The particles were distributed regularly and finely over the working material.

To test for the abrasion resistance, rolls which were produced from the steels without lead or bismuth with a diameter of 40mm were examined in the roll-slide abrasion test. In this test, two cylindrical discs roll on one another in the same direction but at slightly different surface speeds. The slippage amounted to about 0.70 percent and the pressure to 520 N/mm². The result of the test is shown in FIGS. 1 to 3.

Figure 1A:
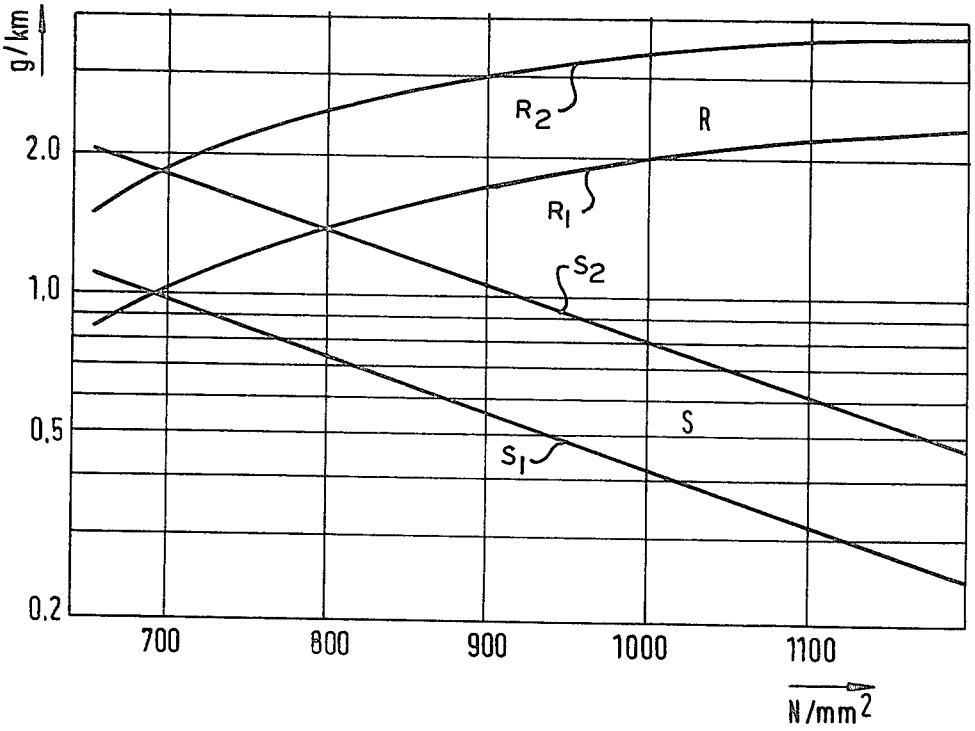
FIG. 1a. PRIOR ART
FIG. 1*a* is a graphical representation showing the relationship between tensile strength and abrasion.

Specifically, FIG. 1*a* is concerned with the abrasion resistance of the prior art rail S and wheel R, and FIG. 1*b* is concerned with the abrasion resistance which results from the rolling contact between wheel R and rail S. Both FIGS. 1*a* and 1*b* show two different steels, with graphical representation S1 being a steel used for a rail S having low tensile strengths which correspond to low carbon and manganese contents, and curve S2 refers to a rail S formed from a steel having high tensile strengths and formed from higher carbon andmanganese contents. In a similar manner wheel R1 has a low tensile strength and is formed from low carbon and manganese content steels and curve R2 has a higher tensile strength and is formed from higher carbon and manganese contents. In FIG. 1*b*, curve U1 refers to the sum of curves R1 and S1 in FIG. 1*a*, and curve U2 refers to the sum of R2 plus S2 in FIG. 1*a*.

The diagrams shown in all of the figures indicate the tensile strength of the examined rail steels along the abscissa. The tensile strength is known to increase with increasing carbon and manganese, possibly chromium, contents. Therefore, from the ranges of analysis given in the table, the low tensile strengths are depicted by curves R1, S1 and U1 which correspond to the low carbon and manganese contents, whereas the high tensile strengths are depicted by curves R2, S2 and U2 and correspond to the higher carbon and manganese contents. All of these curves in FIGS. 2*a*, 2*b*, 3*a* and 3*b*, are provided for comparison with the prior art.

Figures 3A, 3B:
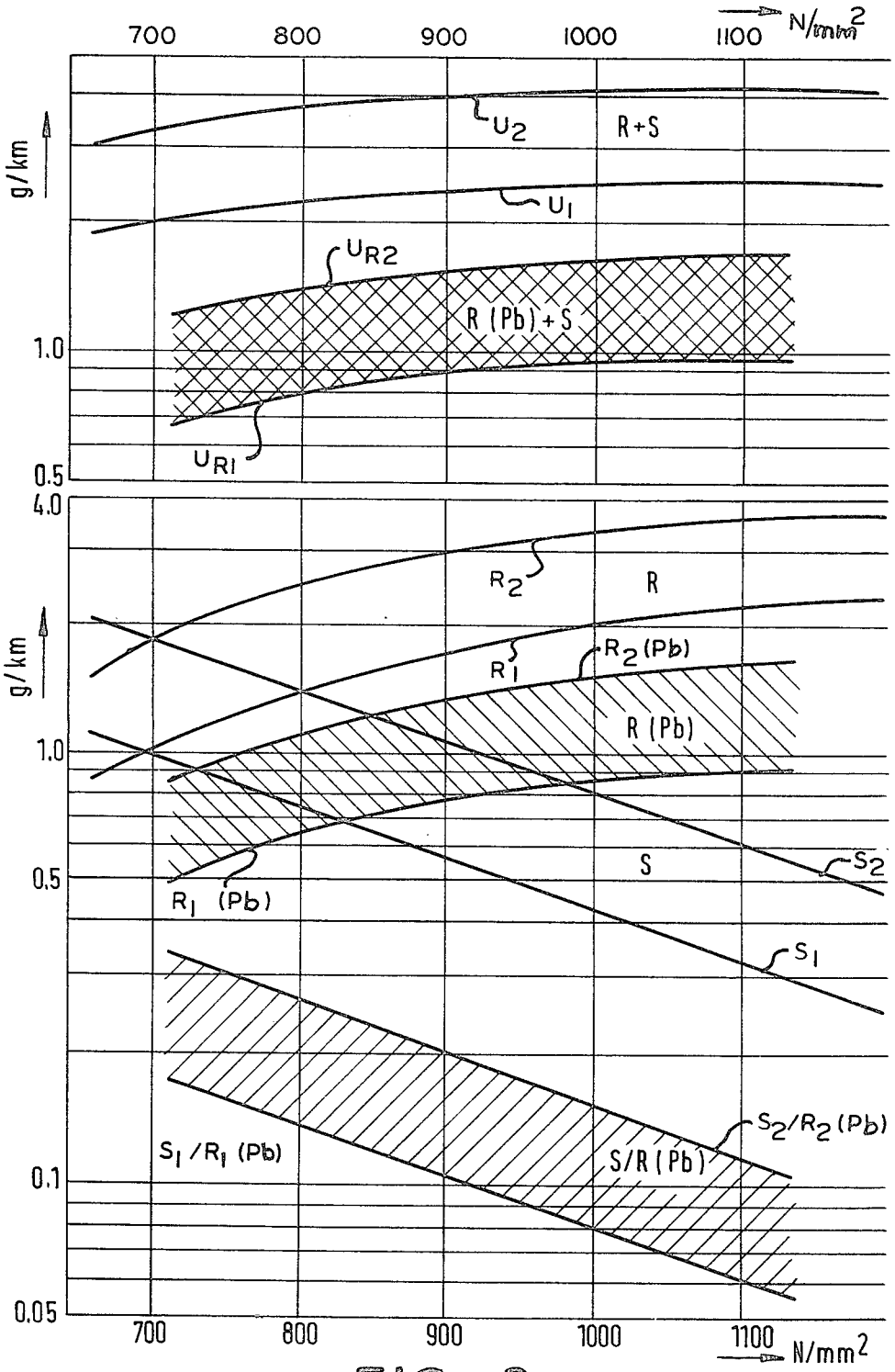
FIG. 3*a* is generally similar to FIG. 2*a*, but here shows the lead added to the wheel and a rail without lead.
FIG. 3*b* is generally similar to FIG. 2*b* and shows the comparison between the slide abrasion behavior of a wheel and rail without lead as compared to a wheel with lead added and a regular rail without lead.

In all of the graphs in all of the figures, the ordinate designates the abrasion which is given in grams for a 1km slide path on logarithmic scale. In FIGS. 1*a*, 2*a* and 3*a*, the abrasion is given individually for the rail S and for the wheel R, whereas in FIGS. 1*b*, 2*b* and 3*b* the total abrasion U=R+S (wheel and rail) is added.

FIG. 1*a* indicates and illustrates the known interrelation, that as the tensile strength of the rail steel increases, the abrasion in the area of rail S decreases linearly, whereas the abrasion in the area of the wheel R increases. The total abrasion U wheel plus rail (R+S) as shown in FIG. 1*b* shows a slight tendency to increase as the tensile strength increases. The curves according to the prior art FIGS. 1*a* and 1*b* were entered in FIGS. 2*a* and 2*b*, and FIGS. 3*a* and 3*b* for comparison purposes. Moreover, the abrasion for the lead alloyed rails and lead alloyed rail wheels produced according to the invention have been represented as shaded areas in FIGS. 2*a* and 3*a*.

In FIG. 2*a*, the effect of adding lead (Pb) to the rail S, shows that in comparison with the known rail S the abrasion in the case of the lead alloyed rail S (Pb) drops on the average by half, whereas the linear dependence remains with increasing tensile strength. The lowest shaded curve R/S (Pb) which indicates the range between the high and low tensile strength steels shows the abrasion of the wheel R (without lead) which runs or rolls against the lead alloyed rail S (Pb). In FIG. 2, the lead is added to the rail S, and $S_1$ (Pb) indicates lead added to a steel of low tensile strength, and $S_2$ (Pb) indicates the lead added to a rail of high tensile strengths. In a similar manner, the other designations follow the same relationship. In FIG. 2*b*, $U_{S1}$ (indicates the abrasion) indicates the abrasion effect of the sum with lead added to the rail when compared to the prior art $U_1$, and $U_{S2}$ is for a high tensile strength steel rail when compared to the prior art $U_2$.

In contrast to the prior art cures $R_1$, $R_2$, $S_1$ and $S_2$, the wheel abrasion in the shaded area has dropped to one fifth of the original value. This is brought about by the addition of lead in accordance with the invention. The total abrasion of a non-leaded steel wheel plus a lead alloyed rail, R+S (Pb), is shown in FIG. 2*b*. If, for example, one singles out a tensile strength of 700 N/mm², then an abrasion amount of about (R+S) on average=2.5 g/km slide path results in the prior art, whereas with the lead alloyed rail in accordance with the invention (shaded area) an abrasion amount of merely about R+S (Pb)=0.75 g results, i.e. the abrasion is less than one third of that of the prior art.

In FIGS. 3*a* and 3*b*, the addition of lead to the steel for the wheel is compared with the prior art steel. A corresponding interrelation results from FIG. 3 which shows the slide abrasion behavior of the wheel and the rail (R+S) in the use of lead alloyed wheel steels R (Pb). If, for example, one singles out a rail steel tensile strength of 900 N/mm², then the abrasion of the known wheel R decreases from about 2.3 g to R (Pb) and equals 1.0 g, see curves $R_1$ and $R_2$ which decrease to $R_1$ (Pb) and $R_2$ (Pb) respectively, for the lead alloyed wheel (lower shaded area). The abrasion of the rail decreases from S=0.8 g, see $S_2$ to S/R (Pb) equals 0.14 g, see $S_1/R_1$ (Pb). FIG. 3*b*, with curves $U_{R1}$ and $U_{R2}$ shows the total abrasion of wheel and rail. For the stated tensile strength of 900 N/mm², a total abrasion of 3.0 g results on average with the prior art (R+S), whereas the total abrasion with the subject of the invention amounts to merely 1.2 g, see shaded area of R (Pb)+S between curves $U_{R1}$ and $U_{R2}$.

In view of the improved abrasion behavior, the service life improves by more than 100%. This provides the possibility of leaving the previous development of effecting high abrasion resistance by heavy increase in tensile strength. Steels with lower strength properties which show considerably more tenacity or toughness can also be used as rail steels and therefore low-carbonized steels with carbon contents of less than 0.40 percent can be used as rail steels.

The rails produced which are from the steels alloyed with lead (Pb) or bismuth (Bi) according to the invention are particularly suitable for curves, mountain stretches, corners and other areas which result in the heaviest abrasion.

While there has been shown what is considered to be the preferred embodiments of the invention, it is to be understood that various changes and modifications may be made therein without departing from the scope of the invention.

We claim:

1. In a unit composed of a railway rail and a railway wheel adapted to travel thereover, said rail and said wheel being formed from a steel for railways comprising in percent by weight no more than 0.80% carbon, no more than 1.50% silicon, no more than 3.50% manganese, no more than 4.00% chromium; with the total contents of manganese and chromium together not exceeding 4.50% and the remainder iron and other alloying elements used in steels for railway rails and railway wheels, the improvement comprising:

adding an alloying material selected from the group consisting of lead and bismuth in an amount in the range of 0.02 percent to 0.35 percent by weight to the steel used for the railway rail or the railway wheel.

2. In the unit as claimed in claim 1, wherein said steel is selected from a steel having a composition by weight consisting essentially of 0.40 to 0.80% carbon, a maximum of 1.50% silicon, 0.70 to 2.10% manganese, with further additions of up to 2% chromium, up to 0.5% niobium, up to 0.25% molybdenum, up to 0.25% vanadium, up to 0.25% titanium with the remainder iron.

3. In the unit as claimed in claim 1, wherein the steel is selected from the group consisting of:

natural hard, low alloyed steels comprising in percent by weight 0.14 to 0.39% carbon, 0.15 to 0.60% silicon and 0.50 to 0.80% manganese with a minimum tensile strength of more than 350 N/mm$^2$ and less than 650 N/mm$^2$, a steel having a very fine pearlitic structure and a minimum tensile strength of 700 N/mm$^2$ in a heat treated state and having composition by volume consisting essentially of 0.40 to 0.80% carbon, a maximum of 1.50% silicon, 0.70 to 2.10% manganese, with further additions of up to 2% chromium, up to 0.5% niobium, up to 0.25% molybdenum, up to 0.25% vanadium, up to 0.25% titanium with the remainder iron, a steel comprising in percent by volume of 0.28 to 0.35% carbon, 0.20 to 1.50% silicon, 0.50 to 3.50% manganese, 1.25 to 4.00% chromium, with the sum of manganese plus chromium 2.75 to 4.50% up to 0.40% molybdenum, 0.40% vanadium and up to 0.010 boron having a bainitic structure with a minimum tensile strength of 1100 N/mm$^2$, and a steel having a minimum tensile strength of 600 N/mm$^2$ in its quenched and tempered state and a structure composed of tempered martensite.

4. In the unit as claimed in claim 2 or 3, wherein total content of lead plus the bismuth is between 0.07 and 0.20 percent by weight of the steel.

5. In the unit as claimed in claim 2 or 3, wherein solely lead is used as the alloying element.

6. In the unit as claimed in claim 1, wherein the steel is selected from the group consisting of natural hard, low alloyed steels with a minimum tensile strength of more than 350 N/mm$^2$ and less than 650 N/mm$^2$, a steel having a very fine pearlitic structure and a minimum tensile strength of 700 N/mm$^2$ in a heat treated state, a steel having a bainitic structure with a minimum tensile strength of 1100 N/mm$^2$, and a steel having a minimum tensile strength of 600 N/mm$^2$ in its quenched and tempered state.

7. In the unit as claimed in claim 1, wherein said steel is selected from a steel having a very fine pearlitic structure and a minimum tensile strength of 700 N/mm$^2$ in a heat treated state.

8. In the unit as claimed in claim 1, wherein said steel is selected from a steel having a bainitic structure with a minimum tensile strength of 1100 N/mm$^2$.

9. In the unit as claimed in claim 1, wherein said steel is selected from a steel having a structure of tempered martensite with a minimum tensile strength of 600 N/mm$^2$ in its quenched and tempered state.

10. In the unit as claimed in claim 1, wherein said steel is selected from a natural hard, low alloyed steel with a minimum tensile strength of more than 350 N/mm$^2$ and less than 650 N/mm$^2$.

11. In the unit as claimed in claim 1, 6 or 7, wherein the total content of the lead and bismuth is between 0.07 and 0.20 percent by weight of the steel.

12. In the unit as claimed in claim 1, 6, 7, 8, 9 or 10, wherein solely lead is used as the alloying element.

* * * * *